United States Patent [19]

Bonner, Sr.

[11] 4,208,768

[45] Jun. 24, 1980

[54] CAN COILER MECHANISM CAN CHANGER

[75] Inventor: Alvin T. Bonner, Sr., Mauldin, S.C.

[73] Assignee: John D. Hollingsworth on Wheels, Inc., Greenville, S.C.

[21] Appl. No.: 899,857

[22] Filed: Apr. 25, 1978

[51] Int. Cl.[2] ..... D01H 9/18

[52] U.S. Cl. ..... 19/159 A; 57/281

[58] Field of Search ..... 19/159 R, 159 A; 242/54.4, 82, 83; 28/289, 290; 57/281

[56] References Cited

U.S. PATENT DOCUMENTS 3,028,637 4/1962 Van Deusen ..... 19/159 A 3,354,513 11/1967 Fornes ..... 19/159 A

FOREIGN PATENT DOCUMENTS 305743 2/1929 United Kingdom ..... 19/159 A

*Primary Examiner*—Louis Rimrodt

*Attorney, Agent, or Firm*—Bailey, Dority & Flint

[57] ABSTRACT

A coiler mechanism has a carrousel type can changing apparatus employing a pivoted power operator for engaging through a spring actuated pawl the can moving mechanism which is provided with a brake so that the can changer repeats, accurately positioning successive cans in the same spot beneath a coiler head each time.

5 Claims, 3 Drawing Figures

12
C
25
30
B
31b
23
29
30a
31
34
D
46
44
26
45
47
21
E
19
17
14
A
20
17
48
18

CAN COILER MECHANISM CAN CHANGER

BACKGROUND OF THE INVENTION

Automatic can changing devices have heretofore included carrousel devices such as illustrated in U.S. Pat. No. 3,354,513. Such carrousel devices usually have employed power operated mechanism including gear motors for theoretically stopping for positioning an empty can in the same position each time beneath the coiler head. However, such devices have a tendency to produce a cumulative error. While such a device is self-locking, such error has been found to be multiplied as repetitive can changing operations take place. Such devices require considerable power because they are generally operated against the force of a braking mechanism.

Accordingly, it is an important object of this invention to provide a coiler with a carrousel type can changer which requires less power and which accurately repeats its can changing operation, positioning the empty can with respect to the coiler in the same position each time successively.

Another important object of the invention, is to provide a simple rugged can changer which has desirable safety features and which maintains the cans in close relation to each other at all times so as to avoid piling the sliver between them on the floor during a change operation.

Another important object of the invention is to provide a simplified device including the use of a ratchet which is engaged by a pivoted linear power operator and then turned by a return stroke of linear power operator so as to pull rather than push the load.

BRIEF DESCRIPTION OF THE INVENTION

It has been found that a rotary can changer for removing a full can and positioning an empty can with respect to coiler heads of carding machines may be provided utilizing a linear power operator for engaging a ratchet mechanism and then pulling the carrousel mounted cans on a return stroke of the power operator with engagement of a braking mechanism when the return stroke is almost completed. The ratchet means is operated between limit switch mechanism for controlling the power operator to insure, with the braking mechanism, that the cans will be positioned on a change operation in the same location each time.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
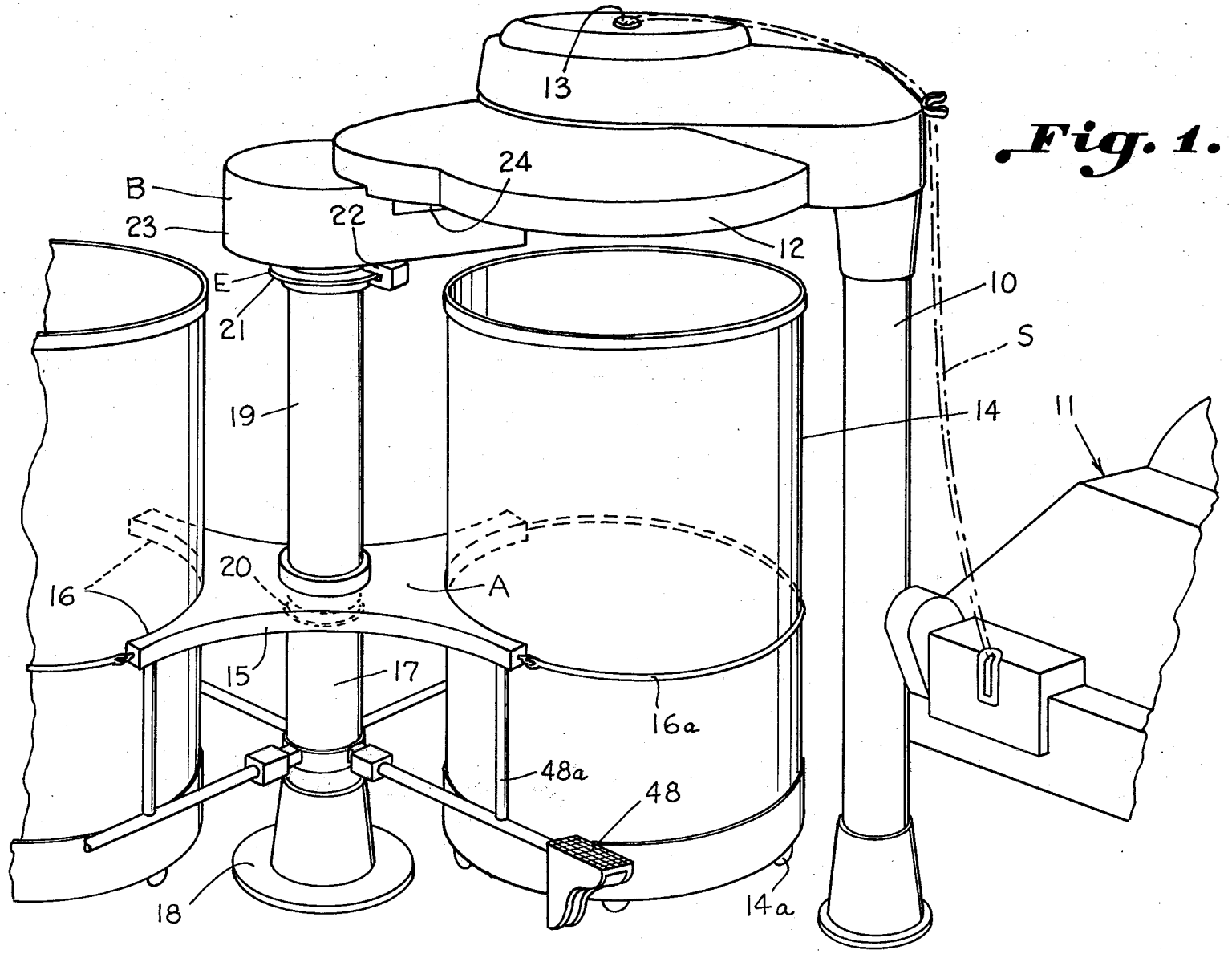
FIG. 1 is a perspective view illustrating a coiler head supplied with sliver from a card for delivery to successive cans which are carried by a rotary can changer constructed in accordance with the present invention.

The drawing illustrates a carding machine coiler mechanism having a coiler head for placing sliver in successive coiler cans. Means are provided for changing coiler cans so as to remove a full can from the coiler and replace it with an empty can including a spider means A for positioning a plurality of circumferentially spaced cans carried for rotary indexing movement about a vertical standard. A housing B is fixed to the coiler head and carried adjacent the top of the vertical standard. Power operated means C for producing linear motion may include an air cylinder pivoted on one end thereof on the housing. Ratchet means D are connected to the power operated means on the other end thereof so as to be operated by the power operated means in an advancing movement thereof to engage the can positioning means for indexing movement responsive to a return movement of the power operated means. Braking means E lock the can positioning means with respect to the housing for positively positioning successive cans in a predetermined position each time with respect to the coiler head on a return movement of the power operated means.

Referring more particularly to FIG. 1, a coiler drive post 10 is carried adjacent a carding machine, broadly designated at 11 for supplying sliver S to a coiler head, designated at 12. The coiler head is illustrated as being provided with the usual trumpet 13 for receiving sliver and delivering same from a tube, not shown, into a can 14. A succession of cans 14 may be provided in each of the four or more positions defined by arcuate portions 15 of a spider member A having arms 16 which is carried for rotation on a central vertical standard 17 which may be suitably secured to the mill floor as upon a pedestal 18. Straps **16*a* carried by adjoining arms 16 secure the cans 14 which are provided with casters 14*a* in each position. A turntable may be provided if cans without casters are to be positioned. A tubular member 19 carries the spider A fixedly connected at a lower portion thereof. The tubular shaft is carried upon the post or fixed vertical standard 17 as upon a lower thrust bearing 20. A disk portion 21 of a disk brake assembly is provided for being actuated by closure of opposed calipers carried on each side of the disk by the yoke 22. The drive housing B having vertical walls 23, which contains the ratchet operating mechanism, is suitably secured to the coiler head 12 as by securement of a flange 24 as by bolts 25** (FIG. 2).

Figure 2:
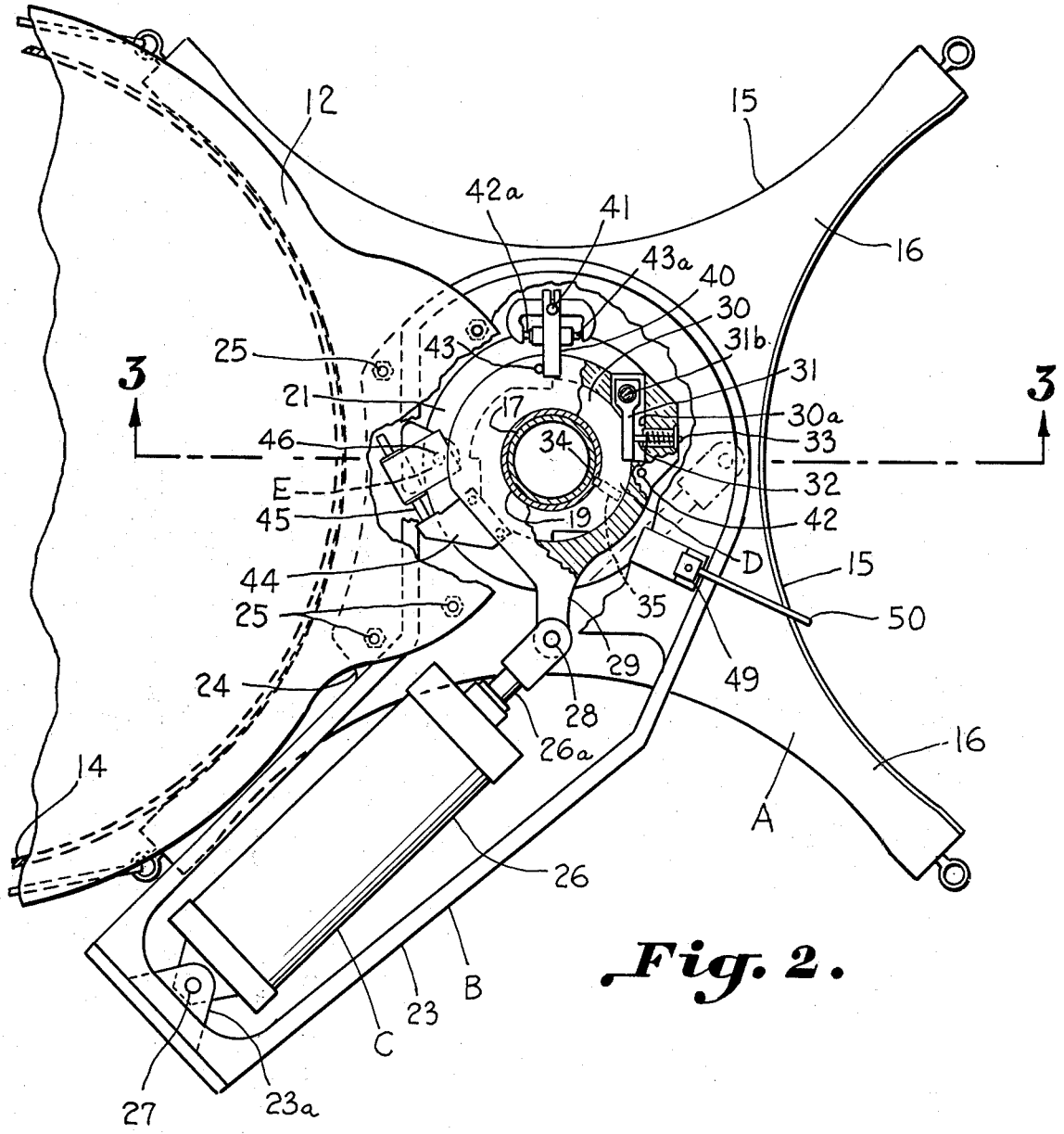
FIG. 2 is an enlarged top plan view, with parts omitted and parts broken away for clarity of illustration, schematically portraying the power operated mechanism for engaging the ratchet mechanism of the present invention preparatory to a return stroke for rotating the cans positioning an empty can beneath the coiler head after removing a full can and for actuating braking mechanism to positively position the cans accurately and repetitively.

Referring more particularly to FIG. 2, the power operated mechanism C is illustrated in the form of an air cylinder 26 which has pivotal connection on one end as at 27 to the drive housing wall 23, through a bracket **23*a* fixed thereon. The air cylinder may be operated as by the usual solenoid operated valve for controlling air pressure or by any other desirable means. It should be noted at this point that any linear actuator may constitute the power operated element, and such may be in the form of an electrical linear actuator in lieu of the air cylinder and may take the form of Warner Electric's Electromechanical Actuator. The air cylinder is illustrated as having the free end of its piston rod 26a connected for pivotal movement as at 28 to a fulcrum arm or cage 29. The fulcrum arm carries a ratchet wheel 30 within an internal housing 30a which also carries a pawl 31 for actuation by a plunger 32, which is actuated by a suitable spring arrangement illustrated schematically at 33. The pawl 31 is illustrated as being pivoted as at 31b within the fulcrum arm or cage 29. It will be noted by reference to FIG. 2, that the ratchet 30 is keyed to the vertical tubular member 19 as at 34. The ratchet wheel 30 is thus positioned at the top of the tubular shaft or torque tube 19 above the cans 14. The ratchet wheel is fixed on the tubular member 19 as by a key 34 and set screw 35 (FIG. 2). The ratchet wheel serves as a bearing for the fulcrum arm or cage 29** and carries same for rotation.

The can changer rotates the cans an equal number of degrees removing a full can and replacing it with an empty can. The cylinder or actuator is in a closed position, as shown, before actuation thereof responsive to any of the usual suitable electrical sensing mechanisms (not shown) for indicating can changing is necessary. The cylinder or actuator 26 then moves the fulcrum arm or cage 29 counter-clockwise a predetermined number of degrees, past a point of locking for the pawl 31 for engagement with the ratchet wheel 30.

The cage 29 trips a switch by engagement of a pivoted arm 40 carried by the drive housing A as at 41 engaging a pin 42 which closes first contacts 42a carried by the housing. After moving a predetermined number of degrees, a second contact 43 closes second switch contacts 43a actuating an air valve, not shown, to actuate the air cylinder which thereafter starts to return. The return of the cage 29 lets the pawl engage with the ratchet wheel and moves the cans, removing the full can from under the coiler and replacing it with an empty can. Thus, the load is pulled rather than pushed for greater efficiency.

Figure 3:
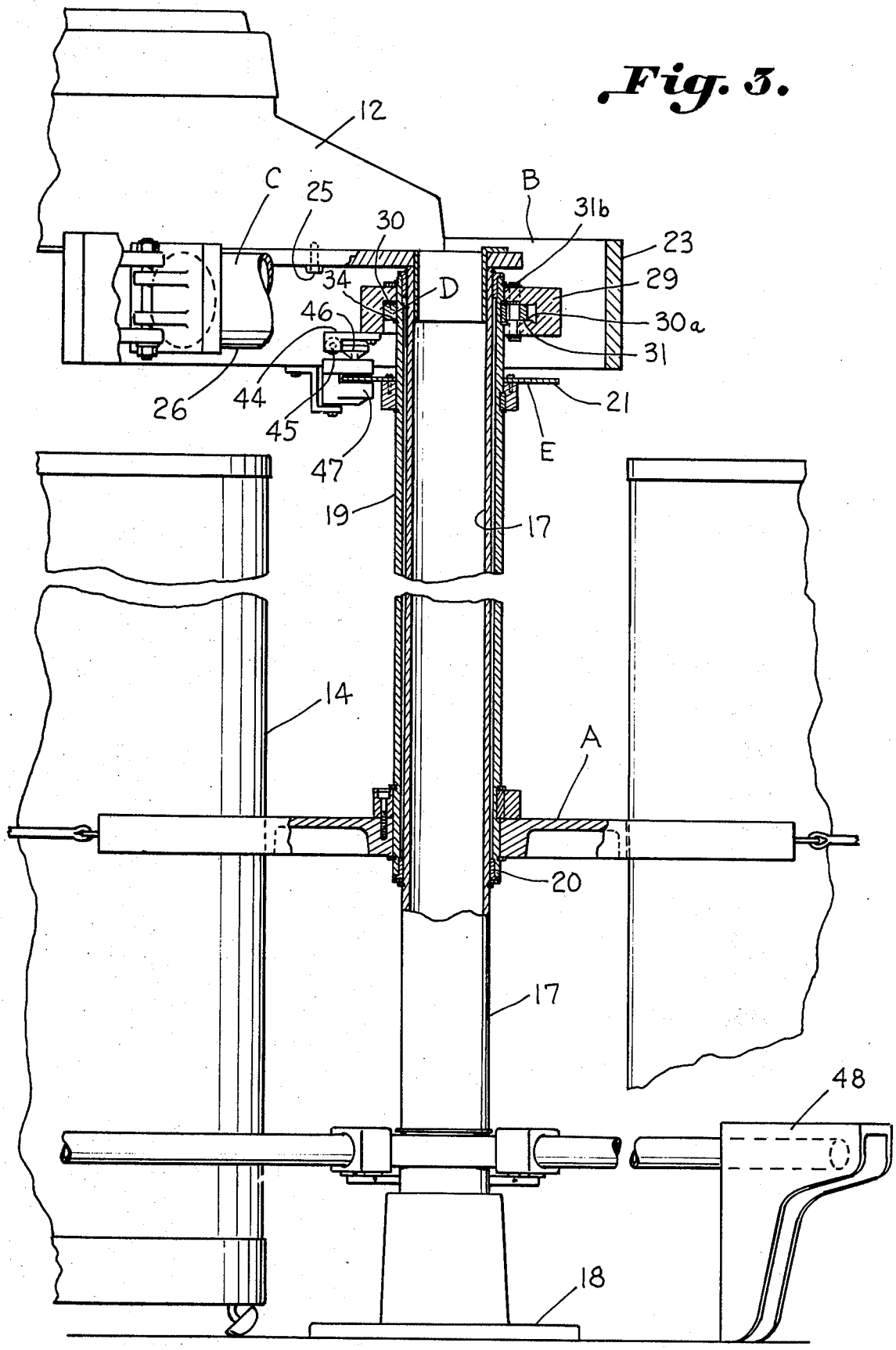
FIG. 3 is a transverse, sectional elevation further illustrating the ratchet and braking mechanism, as well as auxiliary apparatus for the rotary can changer.

The brake includes the disk 21 (FIGS. 1 and 3) which is engaged on the return stroke of the cylinder or actuator. The brake engages a short distance from the end of the returning stroke to overcome the inertia of the cans and mechanism. The brake is engaged by a lever 44 attached to the cage 29. The brake has a spring loaded arm 45 (FIG. 2) that applies power to operate the cam 46 of the caliper brake mechanism to cause engagement of the opposed calipers with the fixed disk 21 (FIGS. 1 and 3). The brake remains on until the changer is again actuated for a change, therefore, the brake locks the cans in position during the time the can is being filled.

To facilitate putting up the sliver, there are steps 48 (FIGS. 1 and 3) at the lower part of the stationary standard near the floor. The steps are mounted for rotation on the stationary tube 17 and are tied to the spider 16 as by connectors 48a so they will rotate as the cans rotate. The steps are interlocked by a switch (not shown) that stops the rotation of the changer if they are being used. Referring to FIG. 2, a suitable switch mechanism 49 is actuated by a wire sensor 50 which engages the sliver above a full can as a protective device to stop the mechanism to avoid inserting an already full can under the coiler head.

It is thus seen that a simplified rotary card can changer has been provided. Such a device has special utility in connection with high speed carding where it is particularly undesirable to slow down or stop the carding machine to effect the can change and put the web and sliver up. The present device is also rugged and capable of the repeated frequent stops necessary for high speed operation.

While a preferred embodiment of the invention has been described using specific terms, such description is for illustrative purposes only, and it is to be understood that changes and variations may be made without departing from the spirit or scope of the following claims.

What is claimed is:

1. In a carding machine coiler mechanism having a coiler head for placing sliver in successive coiler cans, means for changing coiler cans so as to remove a full can from the coiler head and replace it with an empty can comprising:

means for positioning a plurality of circumferentially spaced cans carried for rotary indexing movement about a vertical standard permitting manual removal of a full can therefrom and reception of an empty replacement can thereby;

a housing fixed to said coiler head and carried adjacent the top of said vertical standard;

an extensivle linear actuator for producing linear motion pivoted on one end thereof on said housing;

sensing means actuating said linear actuator when a can changing operation should take place;

a cage member;

ratchet means carried by said cage member pivotally connected to said extensible linear actuator in an advancing movement thereof to engage said can positioning means for indexing movement responsive to a return movement of said extensible linear actuator; and braking means locking said can positioning means with respect to said housing for positively positioning successive cans in a predetermined position each time with respect to the coiler head on a return movement of said extensible linear actuator.

2. In a card coiler mechanism having a coiler head for placing sliver in successive coiler cans, means for changing coiler cans so as to remove a full can from the coiler head and replace it with an empty can comprising:

a vertical standard; p1 can positioning means carried for rotary indexing movement about said vertical standard permitting manual removal of a full can therefrom and reception of an empty replacement can thereby;

a housing fixed to said coiler head and carried adjacent the top of said vertical standard;

power operated means for producing a linear power stroke pivoted on one end on said housing;

sensing means actuating said power operated means when a can changing operation should take place;

ratchet means driven by said power operated means to engage and index said can positioning means;

braking means actuated responsive to predetermined movement of said can positioning movement locking said can positioning means with respect to said housing for positively positioning successive cans in a predetermined position each time with respect to the coiler head; said braking means including:

a disk carried by said tubular shaft; and caliper means carried by said housing for engaging said disk.

3. In a card coiler mechanism having a coiler head for placing sliver in successive coiler cans, means for changing coiler cans so as to remove a full can from the coiler head and replace it with an empty can comprising:

a vertical standard;

can positioning means carried for rotary indexing movement about said vertical standard permitting manual removal of a full can therefrom and reception of an empty replacement can thereby;

a housing fixed to said coiler head;

a vertical member rotatable upon said standard;

power operated means carried by said housing engaging said can positioning means for imparting indexing movement thereto;

sensing means actuating said power operated means when a can changing operation should take place;

braking means locking said can positioning means with respect to said housing for positively positioning successive cans in a predetermined position each time with respect to the coiler head after each indexing movement thereof, said braking means including;

a horizontal disk carried by said standard in fixed relation to said can positioning means; and means carried by said housing for engaging said disk.

4. The structure set forth in claim 3 including a ratchet fixed to said vertical member and means engaging said ratchet on a forward stroke of said power operated means for indexing said cans on a return stroke.

5. The structure set forth in claim 4 including switch means carried by said housing engageably by means for limiting the indexing operation of said power operated means, and means carried in fixed relation to said ratchet to actuate said brake.

* * * * *